US005921870A

United States Patent [19]

Chiasson

[11] Patent Number: 5,921,870

[45] **Date of Patent: *Jul. 13, 1999**

[54] AERODYNAMIC SHAFT

[76] Inventor: James P. Chiasson, 603 S. Prospect St., Burlington, Vt. 05401

[ * ] Notice: This patent issued on a continued prosecution application filed under 37 CFR 1.53(d), and is subject to the twenty year patent term provisions of 35 U.S.C. 154(a)(2).

[21] Appl. No.: 08/761,529

[22] Filed: Dec. 6, 1996

[51] Int. Cl.[6] ..... A63B 53/10; A63B 53/12

[52] U.S. Cl. ..... 473/317; 473/320; 473/321

[58] Field of Search ..... 473/316, 317, 473/315, 327, 299, 297; 280/819

[56] References Cited

U.S. PATENT DOCUMENTS

| | | | |
|---|---|---|---|
| 1,396,470 | 11/1921 | Taylor | 473/317 |
| 1,435,311 | 11/1922 | Knight . | |
| 1,528,017 | 3/1925 | Gammeter | 473/317 |
| 1,787,415 | 12/1930 | Washington | 473/315 |
| 2,085,915 | 7/1937 | MacCallum . | |
| 2,169,774 | 8/1939 | Taylor | 473/317 |
| 3,596,921 | 8/1971 | Bruckl | 280/819 |
| 3,606,327 | 9/1971 | Gorman | 473/297 |
| 4,541,631 | 9/1985 | Sasse | 473/297 |
| 4,555,112 | 11/1985 | Masghati . | |
| 4,725,060 | 2/1988 | Iwanaga . | |
| 5,050,884 | 9/1991 | Flory . | |
| 5,251,896 | 10/1993 | Gerlach | 473/317 |
| 5,265,911 | 11/1993 | Goode | 280/819 |
| 5,277,423 | 1/1994 | Artus | 473/319 |
| 5,294,119 | 3/1994 | Vincent | 273/DIG. 23 |
| 5,335,908 | 8/1994 | Bamber | 473/317 |
| 5,348,346 | 9/1994 | Unger | 280/819 |
| 5,354,056 | 10/1994 | Cornish | 473/317 |
| 5,390,921 | 2/1995 | De Ruyter | 473/299 |
| 5,393,581 | 2/1995 | Mares | 428/34.1 |
| 5,478,075 | 12/1995 | Saia | 473/238 |
| 5,534,203 | 7/1996 | Nelson et al. | 264/101 |
| 5,545,094 | 8/1996 | Hsu | 473/317 |
| 5,547,189 | 8/1996 | Billings | 473/305 |
| 5,554,078 | 9/1996 | Hannon | 473/292 |
| 5,632,692 | 5/1997 | Lebovici | 473/319 |
| 5,655,975 | 8/1997 | Nashif | 473/316 |
| 5,683,308 | 11/1997 | Monette | 473/318 |

FOREIGN PATENT DOCUMENTS 9417874 8/1994 WIPO .

*Primary Examiner*—Steven Wong
*Assistant Examiner*—Stephen L. Blau
*Attorney, Agent, or Firm*—Downs Rachlin & Martin PLLC

[57] ABSTRACT

A shaft having an outer surface with an aerodynamic cross-sectional configuration. In one series of embodiments, the shaft (20) includes a central core (22) and a fairing (24) surrounding the core. In another embodiment, the shaft does not include a central core. Instead, the shaft (500) includes a central portion (502) that provides structural rigidity and has an outer surface with an aerodynamic cross-sectional configuration. Separate end members (540, 550) are attached to the central portion. The invention includes golf clubs (600, 700) incorporating the aerodynamic shafts and a golf club (800) having a special aerodynamic shaft.

14 Claims, 5 Drawing Sheets

AERODYNAMIC SHAFT

FIELD OF THE INVENTION

The present invention pertains to shafts used in equipment such as ski poles or golf clubs, and more particularly to such shafts having an aerodynamic cross section.

BACKGROUND OF THE INVENTION

Shafts of the type used for golf clubs, ski poles and the like typically have a circular cross section. However, in recent years, shafts with a non-circular cross section have been developed, as described in U.S. Pat. No. 5,534,203 to Nelson et al. (the "'203 patent") and U.S. Pat. No. 5,545,094 to Hsu (the "'094" patent), and in PCT Application WO 94/17874 to Manninen et al. (the "PCT application"). These references do not disclose the use of golf club shafts having a "special aerodynamic" cross section, as defined below. Nor do these references disclose shafts having an "aerodynamic" cross section, as defined below, in which the portion having the aerodynamic cross section is not the primary structural element of the shaft. In addition, these references do not disclose shafts having ends that can be attached to the aerodynamic portion, which ends do not necessarily have an aerodynamic configuration.

Removable sleeves for protecting golf club shafts when not in use are known, as described in U.S. Pat. No. 5,050,884 to Flory and U.S. Pat. No. 5,393,581 to Mares. These sleeves are designed primarily for use with graphite club shafts which can fail at the point where the shaft rubs against the golf bag or other clubs. These sleeves are not intended to improve the aerodynamic characteristics of the shaft when in use, as evidenced by their circular cross section and design which permits removal before use. Instead, they are designed to protect the graphite shafts from abrasive wear.

SUMMARY OF THE INVENTION

One aspect of the present invention is a shaft comprising an elongate core and a fairing surrounding and attached to said core. The outer surface of the fairing has an aerodynamic cross section. Several embodiments of the invention feature a fairing that is designed to be attached to an existing shaft, such as the shaft of a golf club. Other embodiments have fairings that are preferably secured to the core at the time of manufacture.

Another aspect of the invention is an aerodynamic fairing for a shaft. The fairing includes a wall having an outer surface with an aerodynamic cross section. The wall has a tensile strength of less than 40,000 psi. The fairing also includes an inner surface defining an elongate opening for receiving the shaft, with the inner surface being connected to the wall. Means are provided for attaching the inner surface to the shaft.

Yet another aspect of the invention is a shaft having an elongate core and a fairing surrounding and attached to the core. In one embodiment, the fairing has an aerodynamic cross section and a hollow interior region. Fill material is positioned in the interior region of the fairing, with the density of the fill material positioned in a first portion of the interior region being different than the density of the fill material in a second portion of the interior region. In another embodiment, the density of the fairing itself varies as between first and second positions.

Still another aspect of the invention is a shaft having a central portion with an outer surface having an aerodynamic cross section and first and second ends. In addition, the shaft includes a first end member having an outer surface consisting of first and second portions, with the cross-sectional configuration of the first portion being substantially identical to the cross-sectional configuration of the outer surface of said central portion and the cross-sectional configuration of the second portion having a circular or other configuration. In addition, the shaft includes first means for attaching said first end of said central portion to said first end member.

Yet another aspect of the invention is a golf club having a shaft with an aerodynamic cross section, which shaft is the primary structural element of the club and is designed to receive the grip at one end thereof and the club head at the other end.

DETAILED DESCRIPTION OF THE INVENTION

Figure 1:
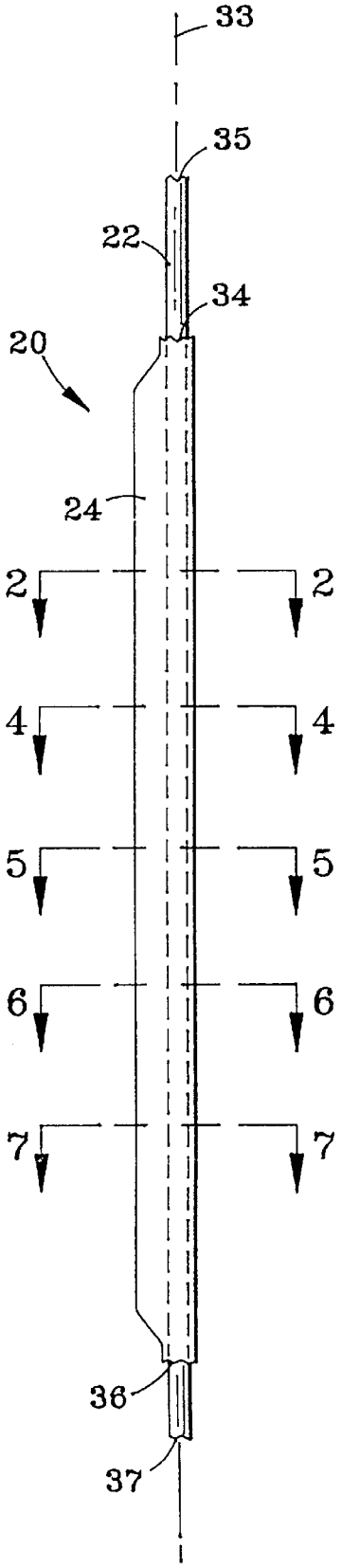
FIG. 1 is a front elevation view of the shaft of the first–fifth embodiments of the present invention.

Referring to FIG. 1, the present invention is a shaft with at least a portion of its outer surface having an aerodynamic cross-sectional configuration. The shaft may be used in a variety of applications where improved aerodynamic properties are desired. For example, the shaft may be used in golf clubs, ski poles, oars, pole vault poles, sailboard masts and booms, and fishing poles.

As used herein, including in the claims, "aerodynamic" means a non-circular cross section designed to reduce turbulence and increase laminar flow in the medium, e.g., the atmosphere, through which the shaft travels, particularly adjacent the shaft's trailing edge, relative to shafts having circular cross sections of similar diameter. A wide variety of cross-sectional configurations are "aerodynamic," as used herein, including oval, elliptical and "tear-drop"

configurations, all subject to the requirement that turbulence be decreased and laminar flow increased in the manner discussed above.

As used herein, including in the claims, "special aerodynamic" means a non-circular cross section designed to reduce turbulence and increase laminar flow in the medium, e.g., the atmosphere, through which the shaft travels, particularly adjacent the shaft's trailing edge, relative to shafts having circular or other non-circular cross sections of similar size. A variety of non-circular cross-sectional configurations are "special aerodynamic," as used herein, subject to the preceding requirements and the two additional requirements. First, the radius of the trailing edge is significantly less (i.e., one-half or less) than that of the leading edge. Second, the cross section is substantially axially symmetric relative to the longitudinal axis of the shaft, as measured along a line extending perpendicular to and intersecting the longitudinal axis and intersecting the most leading portion of the leading edge of the shaft and the most trailing portion of the trailing edge of the shaft.

Figure 9:
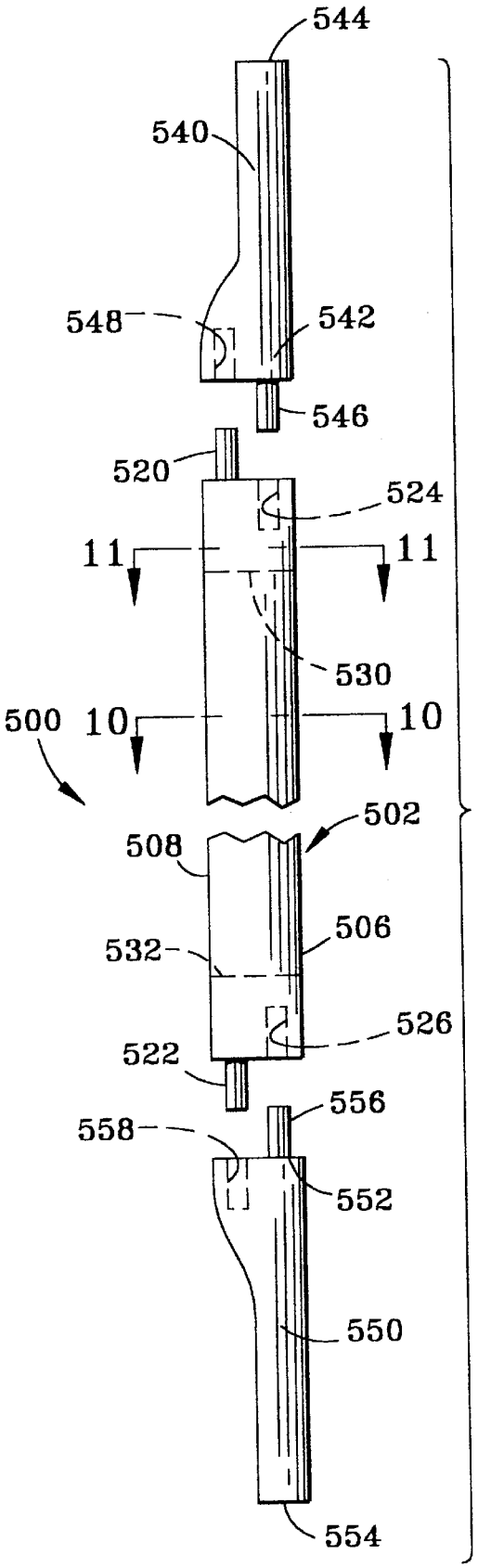
FIG. 9 is an exploded, partially broken, front elevation view of the shaft of the sixth embodiment of the invention.
Figure 10:
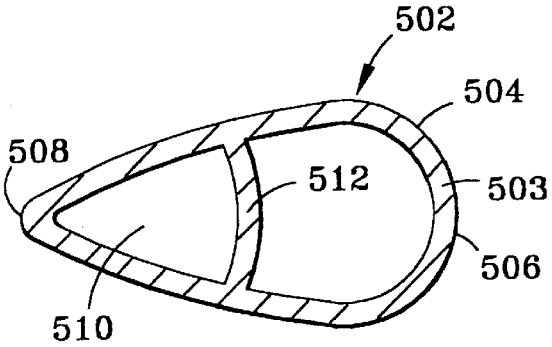
FIG. 10 is a cross-sectional view of the shaft of FIG. 9 taken along line 10—10 in FIG. 9.
Figure 11:
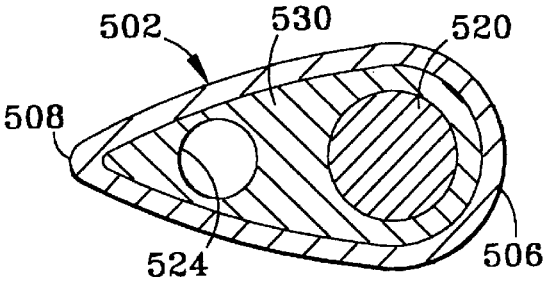
FIG. 11 is a cross-sectional view of the shaft of FIG. 9 taken along line 11—11 in FIG. 9.
Figure 12:
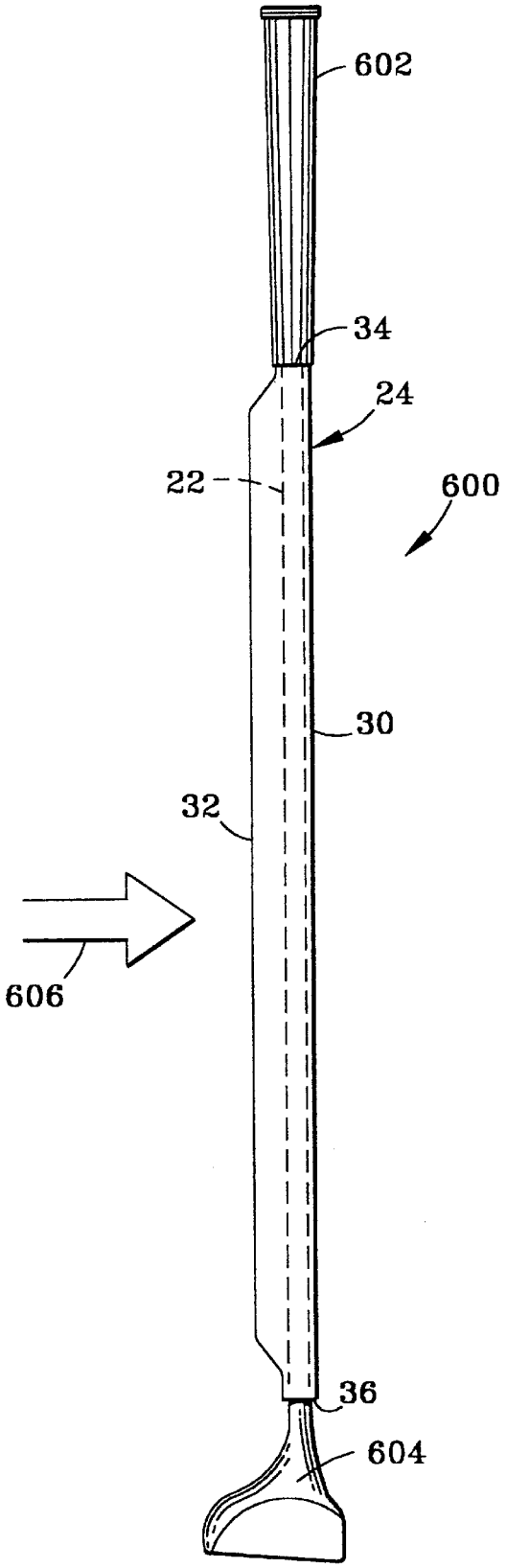
FIG. 12 is a front elevation view of a golf club that includes the shaft of the first–fifth embodiments of the present invention.
Figure 13:
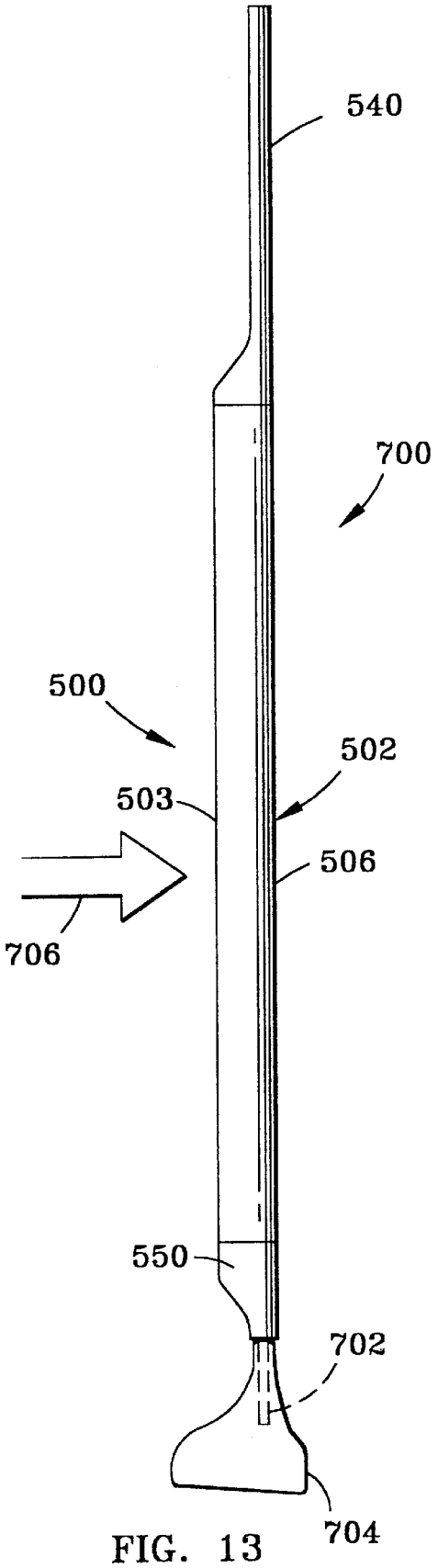
FIG. 13 is a front elevation view of a golf club that includes the shaft of the sixth embodiment of the present invention.
Figure 14:
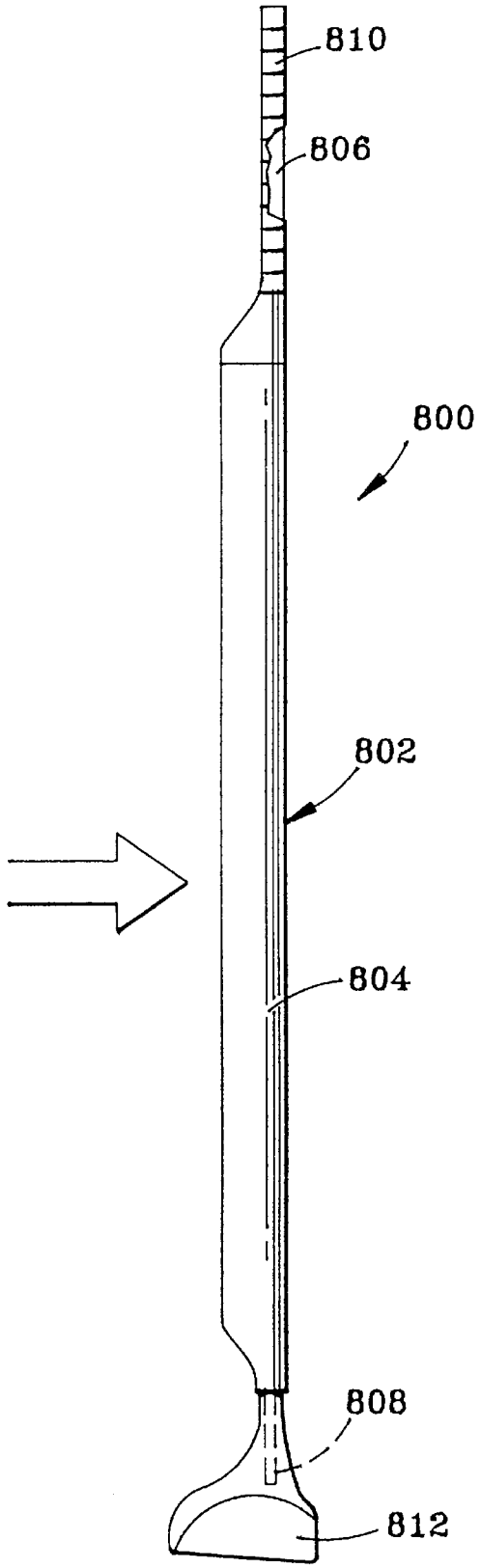
FIG. 14 is a front elevation view of a golf club that includes a unitary special aerodynamic shaft.

The present invention consists of several embodiments which fall in two broad categories. The embodiments illustrated in FIGS. 1–8 are directed to a shaft 20 having a central core member that is the primary structural member and a surrounding fairing providing improved aerodynamic properties (the "core and fairing" embodiments). The shaft of the embodiments illustrated in FIGS. 9–11 features an integral section that provides both the aerodynamic configuration and also is the sole structural member for the shaft. This embodiment also includes end members, the cross section of which changes from aerodynamic to circular or other configuration (the "multi-part" shaft embodiment). A golf club incorporating the shaft of the embodiments of FIGS. 1–8 is illustrated in FIG. 12 and a golf club incorporating the shaft of the embodiments of FIGS. 9–11 is illustrated in FIG. 13. Additionally, a golf club incorporating a special aerodynamic shaft is illustrated in FIG. 14. The embodiments and golf clubs are described below in this order.

Figure 2:
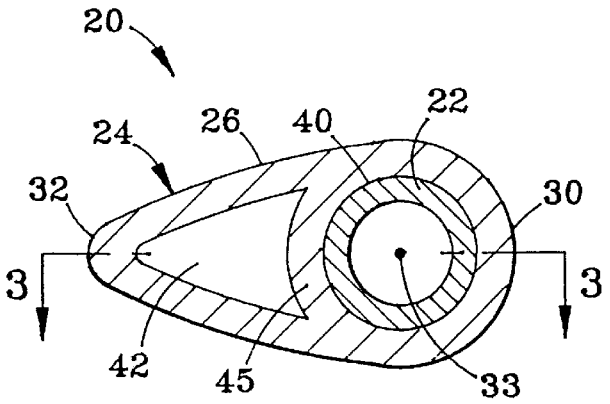
FIG. 2 is a cross-section of a first embodiment of the shaft, taken along line 2—2 in FIG. 1.
Figure 3:
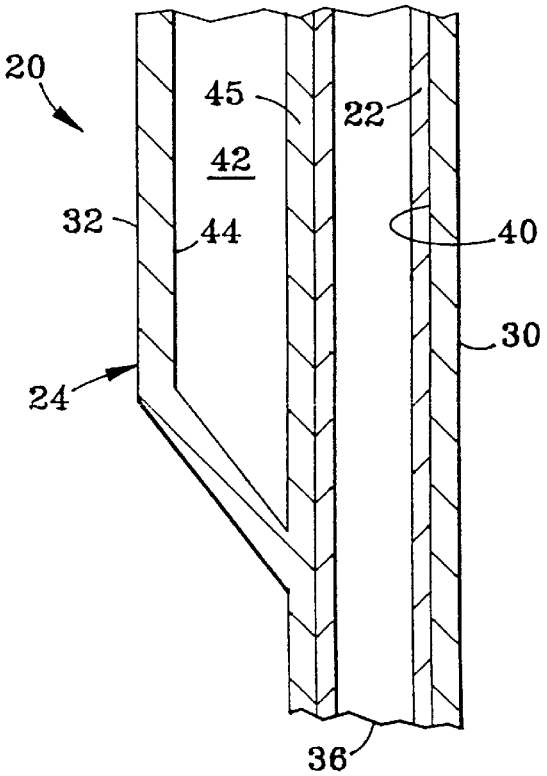
FIG. 3 is a cross-section of a portion of the first embodiment of the shaft taken along line 3—3 in FIG. 2.

In connection with the following general description of the "core and shaft" embodiments (FIGS. 1–8), reference will initially be made to FIG. 1, (which is generic as to all of the core and shaft embodiments), and FIGS. 2 and 3, (which are directed to the first embodiment of the invention). A more detailed description of the embodiments illustrated in FIGS. 2–8 will then be provided.

Shaft 20 includes central core 22 and fairing 24 surrounding at least a portion of, and attached to, core 22. In this description of generic aspects of the core and shaft embodiments, reference is made to fairing 24 for ease of description. However, the following description of fairing 24 in this generic context pertains equally to fairings 124, 224, 324 and 364 (discussed below) of other core and fairing embodiments of the invention. Core 22 preferably comprises an elongate tube or solid rod having a circular cross section and a tensile strength preferably ranging from 40,000 psi to 150,000 psi. Core 22 may have a gradually tapering outside diameter or may have the same outside diameter over its entire length. For example, a tapered titanium tube having a wall thickness of 0.015" and an outside diameter starting at 0.320" and enlarging to 0.650" may be used as central core 22. Although it tends to be less expensive to produce core 22 having a circular cross-section, non-circular, e.g., oval, cross-sections may also be used for central core 22.

The majority of the strength, rigidity and other structural aspects of shaft 20 is provided by core 22, with fairing 24 being intended primarily to improve the aerodynamic properties of shaft 20. Preferably, fairing 24 is made from a relatively lightweight material, subject to the requirement that it possess sufficient strength to avoid appreciable deformation of its aerodynamic configuration (described below) during intended use. As a result, the tensile strength and rigidity of fairing 24 is typically considerably less than that of core 22. The tensile strength of fairing will vary considerably depending upon its design and material used in its construction. A preferred range is 0.28 psi to 40,000 psi. With core 22 as the primary structural component of shaft 20, and fairing 24 being a relatively inexpensive addition, it tends to be less expensive to produce shaft 20 than aerodynamic shafts known in the art in which the primary structural member has an aerodynamic cross section. (The multi-part shaft embodiment of the present invention illustrated in FIGS. 9–11 is an exception to this general rule.) Moreover, as described below, non-aerodynamic shafts can be readily converted to the aerodynamic shaft of the present invention by installing fairing 24 on such non-aerodynamic shafts.

Outer surface 26 of fairing 24 has an aerodynamic cross-section. To achieve this aerodynamic configuration, the preferred configuration for outer surface 26 features a blunt leading edge 30 which tapers gradually to a relatively pointed trailing edge 32, as measured along line 3—3 in FIG. 2. The outer cross-sectional dimension of fairing 24, as measured along line 3—3 in FIG. 2, between leading edge 30 and trailing edge 32, is typically greater, e.g., 1.25–6 times greater, than the outer cross-sectional dimension of the fairing as measured at outer surface 26 along an axis extending perpendicular to line 3—3 and intersecting longitudinal axis 33 of core 22. This dimensional relationship assumes shaft 20 will be moving through a medium along a path extending substantially parallel to line 3—3 in FIG. 2, such that leading edge 30 first encounters a given imaginary point in the medium and trailing edge 32 last encounters such point. The relative proportions of these dimensions of outer surface 26, and the specific configuration of such surface, are selected to reduce turbulence and improve laminar flow in the medium through which shaft 20 travels, particularly in the region adjacent trailing edge 32. The specific dimensional relationship and configuration chosen will depend upon the application for shaft 20, and can be optimized in accordance with principles of aerodynamics, and more generally principles of fluid dynamics, known in the art. While the "teardrop" shape described above and illustrated in FIG. 2 is preferred, other shapes falling within the definition of "aerodynamic" provided above may also be used for outer surface 26.

Outer surface 26 of fairing 24 is preferably relatively smooth so as to reduce the friction of, and turbulence created by, shaft 20 traveling through the intended medium. While the specific degree of smoothness is not critical to the invention, the smoother the better insofar as reduction of friction and turbulence is concerned.

Fairing 24 preferably, but not necessarily, extends along the entire length of core 22. In some applications, top end 34 of fairing 24 terminates before reaching top end 35 of core 22 and bottom end 36 terminates before reaching bottom end 37 of core 22. For example, if shaft 20 is used in a golf club, it may be desired to attach the grip and club head directly to core 22, hence the need for fairing 24 to be somewhat shorter than core 22. In applications where the angular velocity of the shaft will be greater at one end than the other, e.g., if shaft 20 is used in a golf club, it is important that fairing 24 surround at least the portion of core 22 undergoing the greatest angular velocity, insofar as fluid resistance is nearly proportional to the square of velocity. Preferably, one or both ends of fairing 24 taper(s) smoothly from an aerodynamic configuration to a configuration corresponding to that of core 22.

The means for attaching fairing 24 to core 22 are described below in more detail in connection with the description of the various embodiments of the invention. However, such means may be designed to allow a typical user to readily attach fairing 24 to an existing tube or other shaft, or may require attachment of fairing 24 to core 22 in a manufacturing context. In either case, the attachment means is preferably designed to secure fairing 24 to core 22 with sufficient force that the fairing does not rotate appreciably about longitudinal axis 33 of the core during use of shaft 20.

The foregoing description of the invention at a generic level applies to each of the embodiments thereof illustrated in FIGS. 1–8. All future reference to fairing 24, except as otherwise noted, is provided relative to the fairing of the first embodiment of the invention.

Referring to FIGS. 2 and 3, fairing 24 of the first embodiment includes a longitudinal bore 40 extending through the entire length of the fairing. The inside diameter of bore 40 may be constant along its length, or may taper. Bore 40 is sized to receive core 22 with a close sliding or interference fit. Alternatively, bore 40 may be sized so that core 22 may be received therein with a free sliding fit. In the latter case, suitable adhesives are used to secure core 22 to fairing 24 within bore 40. Fairing 24 includes a hollow interior region 42, the configuration of which is defined by inner wall surface 44 of fairing 24. Bore 40 is separated from interior region 42 by central wall 45.

Fairing 24 may be manufactured by one of several conventional manufacturing processes including extrusion molding, blow molding or other process. Suitable materials for fairing 24 include rigid plastics such as polyurethane and polyethylene, and highly flexible visco-elastic materials such as foam rubber and open-cell polyurethane foams. Alternatively, fairing 24 may also be a metal (e.g., aluminum) extrusion or a composite member, the ends of which change from an aerodynamic cross-sectional configuration to a size and cross-sectional configuration corresponding to that of core 22.

Figure 4:
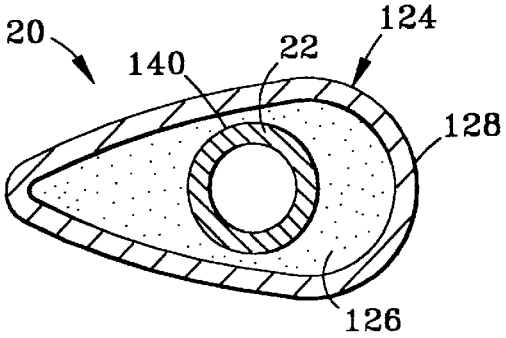
FIG. 4 is a cross-sectional view of a second embodiment of the shaft, taken along line 4—4 in FIG. 1.

Turning to FIG. 4, in a second embodiment of the invention, fairing 124 includes central portion 126 and surrounding cover 128. Central portion 126 preferably has the desired aerodynamic cross-sectional configuration, with cover 128 merely replicating this configuration. Alternatively, portion 126 may have a configuration that approximates the desired aerodynamic configuration, with cover 128 providing the precise configuration desired. Preferably, central portion 126 completely fills the space between core 22 and cover 128. Portion 126 includes central bore 140 for receiving core 22. A suitable material for central portion 126 is a lightweight visco-elastic material such as an open-cell polyurethane foam. Preferably, portion 126 is molded around core 22 so as to securely attach the portion to the core. Alternatively, core 22 may be positioned in bore 140 following manufacture of portion 126 and secured to the portion by friction fit or suitable adhesives.

Outer cover 128 is preferably made from a relatively tough, puncture-resistant (relative to the intended application) material such as an adhesive-backed mylar fill having a thickness ranging from 1 mils to 3 mils. Cover 128 preferably has a relatively smooth outer surface, as discussed above. Cover 128 may be made from a heat shrink biaxial material of the type Dupont sells under the trademark "Clysar." Alternatively, central portion 126 may consist of a self-skinning PVC foam of the type manufactured by Uniroyal and identified as product number BGC and by the trademark Ensolite. The "skin" of the foam constitutes cover 128. Other materials may be used as cover 128, the primary requirements being a relatively smooth outer surface and puncture resistance, as discussed above.

Fairings 24 and 124 are preferably, although not necessarily installed by the manufacturer, rather than the user, of shaft 20. However, the fairing of shaft 20 may be designed so as to be easily installed on core 22 by a typical user of the equipment incorporating shaft 20. Thus, in the following description of the third, fourth and fifth embodiments of the invention illustrated, respectively, in FIGS. 5, 6 and 7, core 22 constitutes, for example, the circular shaft of a golf club, ski pole or sailboard mast.

Figure 5:
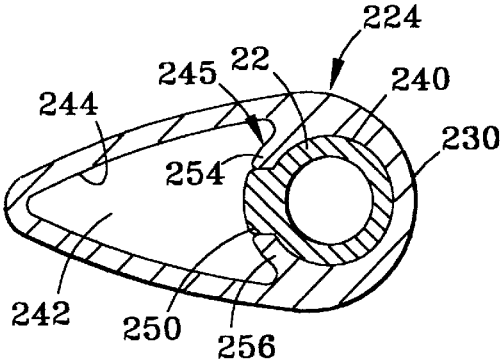
FIG. 5 is a cross-sectional view of a third embodiment of the shaft, taken along line 5—5 in FIG. 1.

The third embodiment of the invention illustrated in FIG. 5 is similar to the second embodiment illustrated in FIG. 2, with the exception of the internal construction of fairing 224. The latter includes central bore 240 for receiving core 22, hollow interior region 242, inner wall surface 244, and central wall 245. An axially extending slot 250 is provided in central wall 245 such that bore 240 communicates via slot 250 with interior region 242. More particularly, central wall 245 includes opposing finger portions 254 and 256 which together define the configuration of slot 250. Finger portions 254 and 256 may extend along the entire length of fairing 224. Alternatively, a plurality, e.g., 2–10 of finger portions 254 and 256 may be provided, with each of the finger portions being axially spaced suitable lengths from adjacent finger portions, e.g., 1–12 inches. Finger portions 254 and 256 have a length and thickness, and are constructed from a material having sufficient resilience, such that once core 22 is positioned in bore 240, fairing 224 will not move axially or rotationally relative to core 22 during the intended use of shaft 20. For example, if shaft 20 will be used as a golf club, finger portions 254 and 256 should be designed and constructed from a material such that fairing 224 win not move axially or rotationally relative to core 22 during use of the golf club or when the golf club is stored in a golf bag or other location. At the same, the design and choice of materials for finger portions 254 and 256, and the diameter of bore 240, need to be selected so that core 22 can be readily positioned in bore 240 either by axially inserting the core directly into bore 240 or by initially positioning the core in interior region 242 and then forcing the core through slot 250 into bore 240. Fairing 224 may be constructed from the materials, and using the manufacturing processes, described above relative to fairing 24.

Alternatively, slot 250 and finger portions 254 and 256 are replaced with a solid wall, such as wall 45 illustrated in FIG. 2, and a slot (not shown) is provided connecting leading edge 230 with bore 240. The width of this slot is chosen so that core 22 may be forced through the slot into bore 240. The latter is sized so that core 22 is prevented from rotating therein, once inserted. In some cases, it may be desirable to attach core 22 in bore 240 with suitable adhesives.

Figure 6:
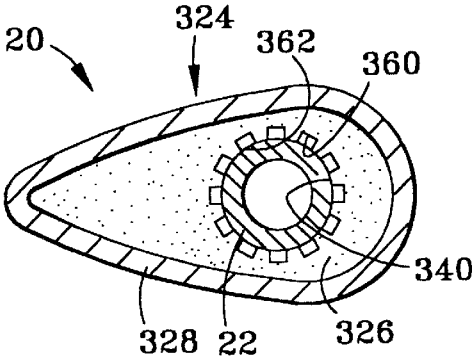
FIG. 6 is a cross-sectional view of a fourth embodiment of the shaft, taken along line 6—6 in FIG. 1.

The fourth embodiment of the invention illustrated in FIG. 6 is similar to the second embodiment of the invention illustrated in FIG. 4, except fairing 324 is designed to permit a typical user to install the fairing on core 22. Fairing 324 includes central portion 326, outer cover 328 and central bore 340 for receiving core 22. Central portion 326 is not molded around core 22, as is the preferred manufacturing process for central portion 126 of the fairing illustrated in FIG. 4. Instead, central portion 326 includes a plurality of axially extending, circumferentially spaced, slots 360 that communicate with bore 340 and separate axially extending, circumferentially spaced fingers 362. The radially innermost surfaces of fingers 362 define bore 340. The latter has a diameter that is slightly less than the outside diameter of core 22. This dimension, together with the choice of material used for inner portion 326, is chosen so that core 22 is held sufficiently tightly by fingers 362 of central portion 326 so that the core does not move axially or rotationally within the central portion during the intended use of shaft 20. Suitable materials for central portion 326 are the same as those described above with respect to central portion 126 of fairing 124 illustrated in FIG. 4. Outer cover 328 of the fairing illustrated in FIG. 6 may be a heat shrink polymer, the skin of a self-skinning foam, or other materials, all as described above with respect to cover 128 of fairing 124.

The above-described construction of fairing 324 is selected to permit a typical user of shaft 20 to install the latter over a preexisting shaft that will serve as core 22. By providing slots 360, circumferential expansion of fingers 362 arising from radial compression of the fingers due to insertion of core 22 in bore 340 is accommodated. As a result of this design, the force required to install core 22 in bore 340 is within the strength range of typical users of this embodiment. This embodiment of the invention encompasses other designs, the primary requirement being (1) the ability to insert core 22 into core 340 with a relatively nominal force of the type a typical user could generate and (2) the ability of central portion 326 to engage core 22 with sufficient frictional force to prevent the central portion from rotating about the core during the intended use thereof Thus, in place of slots 360 and finger 362, a "scalloped" or "knurled" cross sectional configuration for core 340 may be employed.

Figure 7:
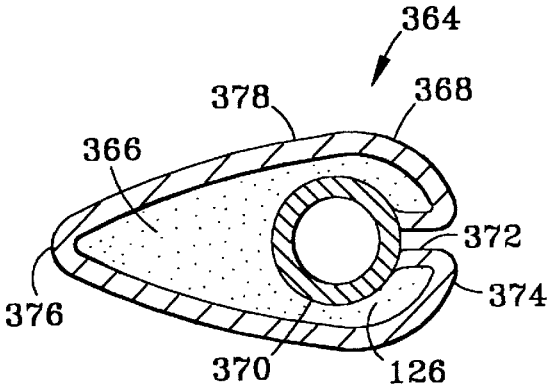
FIG. 7 is a cross-sectional view of a fifth embodiment of the shaft taken along line 7—7 in FIG. 1.

As with the third and fourth embodiments illustrated, respectively, in FIGS. 5 and 6, the fifth embodiment of the invention illustrated in FIG. 7, which includes fairing 364, is designed to permit a user to install the fairing on core 22. Fairing 364 includes central portion 366, outer cover 368 and central bore 370 for receiving core 22. Slot 372 is provided in leading edge 374 of fairing 364. The diameter and choice of materials for central bore 370 and the width of slot 372 are selected so that core 22 may be forced through the slot into the bore and will be retained in the bore due to an interference fit between the core and the sidewall of the bore. Alternatively, bore 370 may be sized so that core 22 is received therein with a sliding fit and a suitable adhesive is applied to secure the core to the bore sidewall. The materials described above for central portion 126 may be satisfactorily used for central portion 366. Alternatively, slot 372 may be formed in trailing edge 376 of fairing 364 or in the side edge 378.

Figure 8:
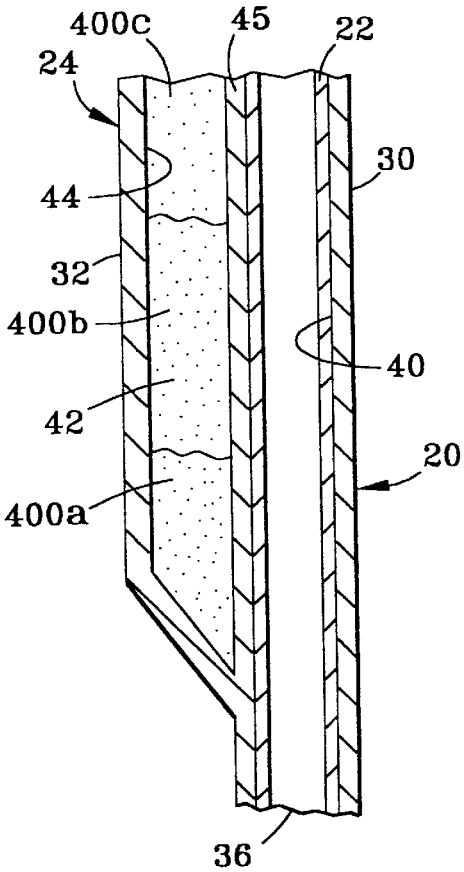
FIG. 8 is an identical view to that of FIG. 3, except that the interior region contains a variable-density fill material.

Referring to FIG. 8, in a variation of the embodiments having a fairing with a hollow interior region, e.g., fairings 24 and 224, the respective interior regions 42 and 242 thereof are filled with a variable density material. This variation of the invention is illustrated in FIG. 8 with respect to fairing 24. However, the following description of this variation relative to fairing 24 applies equally to the embodiment of the invention including fairing 224. More particularly, interior region 42 of fairing 24 includes a fill 400, the density of which may be selectively varied along the length and/or width of fairing 24. Suitable materials for fill 400 include open or closed cell foams, such as polyurethane foam, which may include inorganic additives such as marble dust or glass pellets to increase the density thereof. Selection of the appropriate density of fill 400 positioned at a given position along the length of fairing 24 may be determined empirically or by mathematical calculation using known techniques. For example, in a shaft 20 intended to function as a golf club, it is desired that the center of gravity of shaft 20 be located as close to the club head as possible. Hence, relatively high density fill material 400*a* is positioned in interior region 42 adjacent bottom end 36 of fairing 24, intermediate density fill material 400*b* is positioned in an axially central portion of interior region 42, and low density fill material 400*c* is positioned in interior region 42 adjacent upper end 34 of fairing 24.

Alternatively, fill 400 may consist of beads or pellets made from polyurethane or polyethylene. Other materials may also be used as fill 400, the primary requirements being resistance to degradation by heat, moisture or age. Variation in density of fill 400 along the length of fairing 24 is achieved in at least two ways: (1) by using inherently denser materials, at one location and inherently less dense materials at another or (2) by adding density-increasing materials in a first amount to fill 400 at one location in fairing 24 and in a second (lesser or greater) amount at a second location.

The density of the fairings of the second (FIG. 4), fourth (FIG. 6) and fifth (FIG. 7) embodiments may also be varied along the length and/or width thereof by using materials having different densities. For example, referring to FIG. 4, a material having a first density is used for one section of central portion 126 and a material having a second density is used for another section of the central portion.

One advantage of the embodiments of the invention illustrated in FIGS. 1–8 is that it permits the relatively low-cost manufacture of a shaft having an outer surface with an aerodynamic configuration which tapers at one or both ends to a circular cross-sectional configuration. When a unitary member provides both the primary structure and the aerodynamic outer surface of the shaft, the cost of manufacture is often greater than that for shaft 20. This is particularly true when a relatively low-cost tube is used for core 22. As discussed below relative to shaft 500, this increased cost for a unitary shaft can generally be reduced to some extent by using separate end members that provide a transition in the cross section from a central portion having an aerodynamic cross-sectional configuration to ends having a circular or other non-aerodynamic cross-sectional configuration.

Referring now to FIGS. 9–11, shaft 500 (the multi-part shaft embodiment) comprises a middle portion 502 having an outer wall 503. Unlike the embodiments of the invention illustrated in FIGS. 1–8, portion 502 provides structural integrity to shaft 500 and also provides an aerodynamic profile. Outer surface 504 of outer wall 503 has an aerodynamic configuration that tapers from relatively blunt leading edge 506 to relatively pointed trailing edge 508. The outside dimensions of middle portion 502 may be constant along the entire length thereof, or may taper or otherwise vary from one end to the other. To reduce manufacturing costs, portion 502 is preferably made by an extrusion process resulting in a hollow interior 510. To achieve satisfactory strength and reduce weight, one or more webs 512 (FIG. 10) are preferably provided in interior 510 connecting opposite portions of wall 503 together and dividing interior 510 into several separate compartments. Materials having a tensile strength in the range of 40,000–150,000 psi, such as aluminum or titanium, are preferred for portion 502. Other materials such as polyurethane, polyethylene, fiberglass and composite fibers may also be used for portion 502, using manufacturing processes appropriate for such materials.

As described in more detail below, shaft 500 includes end members 540 and 550. To aid in securing members 540 and 550 to portion 502, the latter includes studs 520 and 522 projecting from opposite ends of portion 502 and adjacent respective bores 524 and 526. Stud 520 and bore 524 are provided in block 530 secured in interior 510 of portion 502 adjacent one end thereof and stud 522 and bore 526 are provided in block 532 secured in interior 510 adjacent the opposite end of portion 502.

Shaft 500 includes end member 540 (FIG. 9) having an outer cross-sectional configuration that changes from substantially identical to that of portion 502 at end 542 to a circular or other configuration at end 544. The precise change in outer cross-sectional configuration of end members 540 and 550 will vary with the intended application of shaft 500. End member 540 includes projecting stud 546 and adjacent bore 548. The length and diameter of stud 546 and bore 548 are selected so that the former may be received in bore 524 in portion 502 and the latter may receive stud 520 which projects from the end of portion 502. Shaft 500 includes another end member 550 (FIG. 9) having an outer cross-sectional configuration that changes from substantially identical to that of portion 502 at end 552 to circular or other configuration at end 554. End member 550 includes projecting stud 556 and adjacent bore 558. The length and diameter of stud 556 and bore 558 are selected so that the former may be received in bore 558 in portion 502 and the latter may receive stud 522 which projects from the end of portion 502.

End members 540 and 550 may be secured to portion 502 through the use of known adhesives which are applied to studs 520, 522, 546 and 556 and deposited in bores 524, 526, 548 and 558. Alternatively, the studs may be sized so that they are received with a friction fit in the respective bores. Other structure and materials for securing end members 540 and 550 to shaft 500 are encompassed by the present invention. For example, studs 520 and 522 may be replaced with a shaft (not shown) that extends throughout the entire length of portion 502 and projects beyond the ends of the middle portion in the same manner as studs 520 and 522. Portions 540 and 550 are preferably made from molded polyurethane or polyethylene, although other materials and manufacturing processes may also be used.

An important advantage of shaft 500 is that it permits the relatively low cost manufacture of a shaft having an aerodynamic cross-sectional configuration along a portion of it length which tapers at its ends to a non-aerodynamic configuration. When this taper is provided in the ends of a unitary shaft having an aerodynamic section, it is often more difficult and expensive to manufacture the shaft than it is to manufacture shaft 500.

A specific application of shaft 20 is illustrated in FIG. 12. In this application, shaft 20 constitutes the shaft of golf club 600. Core 22 has a circular cross section and projects a selected distance, e.g., 5–12 inches, above top end 34 of fairing 24 (which is again referred to generically, in this paragraph). A conventional grip 602 is attached to such projecting portion of core 22. Similarly, a portion of core 22 extends beyond bottom end 36 of fairing 24 a selected distance, e.g., about 1–6 inches. Club head 604 is attached to such projecting portion of core 22 by conventional means. Head 604 and fairing 24 are attached respectively to core 22 such that when golf club 600 is swung in direction 606, blunt leading edge 30 of outer surface 26 of fairing 24 first passes through a given point in airspace, with trailing edge 32 of outer surface 26 being the last portion of the outer surface to pass through such point. Any of the various fairings described above may be used in golf club 600.

Because of the reduced drag achieved by the provision of fairings 24, 124, 224, 334 or 364 depending upon the embodiment used, it is estimated that club head 604 will be traveling 10–20% faster at the time of contact with the golf ball than would a similar golf club having a shaft with a circular outer cross-sectional configuration. Because the distance a golf ball travels is roughly proportional to the square of the velocity at which it is hit, excluding losses due to air resistance, golf club 600 should result in longer drives for a given input force. Another advantage provided by a golf club shaft having an aerodynamic cross-sectional configuration is that the tendency for the shaft to rotate along its longitudinal axis during the swing is reduced. By reducing such rotation, the golf club 600 tracks the intended path of travel more closely, and hence the golf club head 604 is more likely to contact the golf ball with the intended angular relationship.

Another advantage of the embodiments of the invention illustrated in FIGS. 1–8 is that it permits the manufacture and use of a golf club having an aerodynamic outer surface, while at the same time apparently complying with the rules of the United States Professional Golf Association (USPGA). These rules require the golf club shaft to be basically straight and of axisymmetric construction. Because the primary structural component of shaft 20, i.e., core 22, may have a circular cross section, hence satisfying the axisymmetric requirement, it can be reasonably asserted that shaft 20 meets the rules of the USPGA. No official determination in this regard, however, has been made by the USPGA as of the filing date of this patent.

A specific application of shaft 500 is illustrated in FIG. 13. In this application, shaft 500 constitutes the shaft of golf club 700. End member 540 changes from an aerodynamic cross section to a circular cross section having a diameter and length that is the same as that of a conventional grip for a golf club. Thus, end member 540 constitutes the grip of club 700. Alternatively, the diameter of the circular cross section portion of end member 540 may be reduced somewhat, with this portion then being covered with a conventional golf club grip. The configuration of end member 550 changes from an aerodynamic cross section to a circular cross section having an outside diameter selected to be positioned in bore 702 in club head 704. The diameter of bore 702 is selected so that the circular cross section portion of end member 550 is received therein with a close-sliding fit, with an appropriate adhesive being used to secure the end member within the club head. The design of end members 540 and 550, and the placement of head 704 on end member 550 is selected so that when golf club 700 is swung in direction 706, blunt leading edge 506 of outer surface 504 of fairing portion 502 first passes through a given point in airspace, with trailing edge 508 of outer surface 504 being the last portion of the outer surface to pass through such point. Golf club 700 provides the same benefits as golf club 600, as discussed above: increased velocity of club head 704 at impact with the golf ball and reduced tendency to rotate during the swing.

Another aspect of the present invention is golf club 800 illustrated in FIG. 14. Golf club 800 comprises a shaft 802 having a central portion 804 and integral end portions 806 and 808. The outer surface of central portion 804 has a special aerodynamic (as defined above) cross-sectional configuration. The outer surfaces of ends 806 and 808 preferably have a circular or other cross-sectional configuration that is not special aerodynamic. However, in some cases, the outer surfaces of ends 806 and 808 may have a special aerodynamic cross-sectional configuration. Shafts of the type described in U.S. Pat. No. 5,534,203, which is incorporated herein by reference, may be satisfactorily used as shaft 802. Golf club 800 also include a grip 810 attached by conventional means to end 806. Head 812 is attached by conventional means to end 808.

Golf club 800 possesses an important advantage of the golf clubs 600 and 700. In particular, as a result of the aerodynamic cross-sectional configuration of central portion 804, for a given energy input the velocity of club head 812 at impact with the golf ball is greater than that for golf clubs having a shaft with a circular cross section. In addition, as also discussed above relative to golf clubs 600 and 700, golf shaft 804 has reduced tendency to rotate during the swing. Furthermore, because outer surface 804 has a special aerodynamic cross-sectional configuration, it is believed a greater reduction in turbulence and increase in laminar flow is achieved by shaft 802 than by shafts of the designs illustrated in U.S. Pat. No. 5,545,094.

Since certain changes may be made in the invention described above without departing from the scope of the invention, it is intended that all matter contained in the previous description or shown in the accompanying drawings shall be interpreted in an illustrative and not a limiting sense.

What is claimed is:

1. A shaft comprising:

a. an elongate core; and b. a fairing surrounding and attached to said core, said fairing having an aerodynamic cross section, wherein portions of said fairing are spaced from said core so as to define a cavity therebetween and said cavity is filled with a material, the density of which varies, as determined at different locations in the cavity.

2. A shaft according to claim 1, further comprising:

a. a grip attached to one end of said elongate core; and b. a golf club head attached to an opposite end of said elongate core.

3. A shaft according to claim 1, wherein said elongate core has a longitudinal axis and said density of said material varies along an axis extending parallel to said longitudinal axis.

4. A shaft according to claim 1, wherein said elongate core has a longitudinal axis and said density of said material varies along an axis extending transversely to said longitudinal axis.

5. A shaft according to claim 1, wherein said material comprises first particles and second particles, wherein the density of said first particles is greater than the density of said second particles.

6. A shaft according to claim 1, wherein said material comprises foam having first portions and second portions, wherein the density of said first portions is greater than the density of said second portions.

7. A fairing for a shaft, the fairing comprising:

a. a wall having an outer surface with an aerodynamic cross section, wherein said wall has a tensile strength of less than 40,000 psi;

b. an inner surface defining an elongate opening for receiving the shaft, said inner surface connected to said wall; and c. means for attaching said inner surface to the shaft comprising two or more fingers attached to said wall that define a slot in communication with said opening.

8. A shaft comprising:

a. an elongate core;

b. a fairing surrounding and attached to said core, wherein said fairing has an aerodynamic cross section and a hollow interior region; and c. fill material positioned in said interior region, wherein the density of said fill material positioned in a first portion of said interior region is different than the density of said fill material in a second portion of the interior region.

9. A shaft according to claim 8, further comprising:

a. a grip attached to one end of said elongate core; and b. a golf club head attached to an opposite end of said elongate core.

10. A shaft according to claim 8, wherein said elongate core has first and second ends and said first portion is closer to said first end than said second portion.

11. A shaft according to claim 8, wherein said elongate core has a longitudinal axis and said first portion is displaced relative to said second portion along an axis extending transversely to said longitudinal axis.

12. A shaft according to claim 8, wherein said material comprises first particles and second particles, wherein the density of said first particles is greater than the density of said second particles.

13. A shaft according to claim 8, wherein said material comprises foam having first portions and second portions, wherein the density of said first portions is greater than the density of said second portions.

14. A golf club comprising:

a. a shaft having an elongate, hollow interior with a first region and a second region;

b. a grip attached to said shaft so as to surround said first region;

c. a head attached to said shaft adjacent said second region; and d. fill material in at least a portion of said interior other than only said first region, wherein the density of said fill material positioned in a first section of said at least a portion of said interior is greater than the density of said fill material in a second section of said at least a portion of said interior, further wherein said fill material positioned in said first section and said second section comprises foam.

* * * * *